US006745838B2

(12) United States Patent
Watson

(10) Patent No.: US 6,745,838 B2
(45) Date of Patent: Jun. 8, 2004

(54) CHEMICAL INJECTION CONTROL SYSTEM AND METHOD FOR MULTIPLE WELLS

(76) Inventor: Richard R. Watson, 2015 Glenn Lakes La., Missouri City, TX (US) 77459

( * ) Notice: Subject to any disclaimer, the term of this patent is extended or adjusted under 35 U.S.C. 154(b) by 0 days.

(21) Appl. No.: 10/185,826

(22) Filed: Jun. 27, 2002

(65) Prior Publication Data

US 2003/0056955 A1 Mar. 27, 2003

Related U.S. Application Data

(60) Provisional application No. 60/324,319, filed on Sep. 24, 2001.

(51) Int. Cl.[7] ..... E21B 37/06

(52) U.S. Cl. ..... 166/310; 166/90.1

(58) Field of Search ..... 166/90.1, 310, 166/305.1; 417/393, 540; 92/8, 9, 12.2, 143; 222/249, 275, 389

(56) References Cited

U.S. PATENT DOCUMENTS 2,041,394 A * 5/1936 Belcher ..... 166/90.1
1,181,205 A 1/1968 Godwin
4,610,163 A 11/1983 Johannesson
4,512,187 A * 4/1985 Sigwardt ..... 222/275
4,512,188 A * 4/1985 Erickson ..... 166/90.1
4,635,723 A * 1/1987 Spivey ..... 166/310

FOREIGN PATENT DOCUMENTS

EP 0 443 276 A1 2/1990

OTHER PUBLICATIONS

SkoFlo Sub–Sea Chemical Injection System, Flow Control Industries, Inc., Brochure N. SSCPV 2/99, 6 pp., undated.
Pressure Compensated Flow Controls, PC Series, Catalog 2502, Manatrol Division, Parker Hannifin, 2 pp., undated.

* cited by examiner

*Primary Examiner*—David Bagnell
*Assistant Examiner*—Matthew J Smith
(74) *Attorney, Agent, or Firm*—Browning Bushman P.C.

(57) ABSTRACT

The chemical injection system (10) is provided for controlling the distribution of chemical fluid from a supply conduit (12) into an individual petroleum well at an adjustable rate. The system includes a remotely operated two position control valve (14) connected to the supply conduit, and cylinder (30) having a cylinder bore (31) with first input-output port (34), and a second input-output port (36). The fluid barrier (50, 150, 250, 251) is provided within the cylinder bore, such that chemical fluid flows from the supply conduit through the control valve to one end of the cylinder bore and forces the barrier to displace a fixed volume of fluid. Each operation of the directional control valve reverses travel direction of the barrier within the cylinder bore and injects another fixed quantity of fluid into the well.

29 Claims, 4 Drawing Sheets

CHEMICAL INJECTION CONTROL SYSTEM AND METHOD FOR MULTIPLE WELLS

This application claims the benefit of Provisional application No. 60/324,319 filed Sep. 24, 2001.

FIELD OF THE INVENTION

This invention relates to a methods and systems for controlling the distribution of high pressure petroleum well treatment fluids from a single supply conduit for injection into multiple petroleum wells at individually adjustable rates. More specifically, the present invention relates to a system and method for controlling injection rates which avoids small orifices which may block the injected chemical.

BACKGROUND OF THE INVENTION

The efficient production of oil and gas from subsea wells requires the injection of various treatment chemicals to solve production problems such as corrosion, scale, paraffin, emulsion, and hydrates. Most current chemical injection systems for petroleum wells have a separate chemical supply conduit for each chemical and each well. Often several wells are located near each other, but at significant distance from a surface location for chemical pumping. Prior art systems have been proposed to remotely control the distribution of chemicals to each well at each well's required rate while supplying a field of wells with a single conduit per chemical, as evidenced by the Skoflow system marketed by Flow Control Industries, Inc.

Producing fields with multiple wells, commonly offset at distances of more than 10 miles from the wells to a pump station, and multiple wells located in water depths of more than 900 feet, need a reliable method to control and monitor the distribution of chemicals from a common supply conduit to each well. Prior art equipment has been based on a pressure compensated flow control device which uses a pressure regulating valve in combination with an orifice to regulate the chemical flow at each well. An alternative system with an electric motor driver for a tapered variable clearance screw-shaped passageway is promoted by Scanna. Control is provided by remotely adjusting the orifice size or the pressure regulator valve setting which controls the differential pressure across the orifice. Some devices utilize a fixed large orifice and an adjustable orifice.

A major disadvantage of prior art methods of control and related systems is the small orifice size required to provide a low flow rate; some chemicals require only one or two gallons per day while the common supply conduit must be pressurized to a level to cause flow into the highest pressure well in the field. A differential pressure of several thousand pounds per square inch must flow through a very small orifice to provide flows of a few gallons per day. Contamination by small particles is likely in a sub-sea conduit of many miles length, and these particles can clog the small orifice of prior art systems. Repair or replacement of the plugged orifice may cost hundreds of thousands of dollars.

A separate feedback device is commonly used to determine the actual rate of chemical flow into each well in order to verify adjustments and provide confidence of well treatment. Accurate measurement of low flow rates at high pressure in a sub-sea environment is very expensive.

The disadvantages of the prior art are overcome by the present invention, and an improved method and system for controlling the distribution of well treatment fluids from a single supply conduit for injection into multiple petroleum wells at individually adjustable rates is hereafter disclosed.

SUMMARY OF THE INVENTION

A chemical injection control system constructed in accordance with the present invention includes a remotely operated two position directional control valve fluidly connected to a supply conduit, and a hollow cylinder having a cylinder bore and a first input-output port at one end of the bore. A barrier, such as a piston, separates variable sized chambers between the first and the opposing second input-output port. The second input-output port is fluidly connected to the directional control valve, such that high pressure fluid flows from the supply conduit through the control valve, through one side of the cylinder and forces the piston to displace a fixed volume of fluid from the cylinder bore and through the control valve, then from the discharge port of the control valve to an injection point for an individual petroleum well. Each operation of the directional control valve reverses the travel of the piston in the cylinder bore and causes another fixed volume of fluid to be injected into the individual petroleum well.

A two-position four way directional control valve may be remotely operated by an electric signal or a hydraulic signal, and is of a commercially available design that may accommodate the pressure and flow rate of the injected chemical with great reliability.

It is a feature of the invention that a pressure transducer may be connected to the discharge port of the control valve so that observation of the pressure drop at the valve discharge port may be used to determine the end of travel of the piston or other barrier within the cylinder bore, and thus detect or mark the fixed volume of chemical injected into the injection point of the well. This provides an inexpensive, reliable, and accurate feedback of the actual rate of chemical flow into each well. A flow indication switch alternatively may be used to verify the completion of an injection stroke. A piston position switch alternatively may be used to verify the completion of an injection stroke.

It is another feature of the invention that timing of the actuation of the control valve determines the average chemical flow rate, and verification by a transducer confirms the delivery, i.e., "x" many gallons was injected within "y" seconds, the time between the actuation of an injection stroke and confirmation that the stroke is completed. No small orifices or contamination sensitive components is required.

In one embodiment, two pistons may be employed within the cylinder, with a hydraulic dampening chamber on one side of each piston filled with a clean fluid connected to a pressure compensated flow control valve, which may be adjusted to provide a near continuous chemical flow and avoid interruptions of flow while waiting for the proper time to pass after injection of a fixed volume of chemical is confirmed. This pressure compensated flow control valve may employ a small orifice, but the clean fluid used for dampening would not pose a risk of clogging this orifice.

The present invention has as its principal object a chemical injection system with a large flow path for the chemical so that flow blockage of an orifice by contamination of matter within the injected chemical is avoided.

Another feature of this invention is to provide a reliable, accurate feedback of chemical flow to verify operation and desired well treatment. The system according to the present invention may use individual components which are well known in the oilfield industry for their high reliability.

A preferred embodiment of the invention includes the feature of first and second pistons or other barriers moveable together within the cylinder, with a pair of dampening chambers in fluid communication with a remotely operated control valve.

It is also a feature of this invention to provide a simple control system so that conventional sub-sea control and communication systems may easily interface with this system.

A further feature of the invention is that a piston when used as the barrier may provide a valve on each end for engagement with a seat surrounding one of the inlet/outlet ports.

These and further objects, features and advantages of the present invention will become apparent from the following detailed description, wherein reference is made to the figures in the accompanying drawings.

DETAILED DESCRIPTION OF PREFERRED EMBODIMENTS

Figure 1:
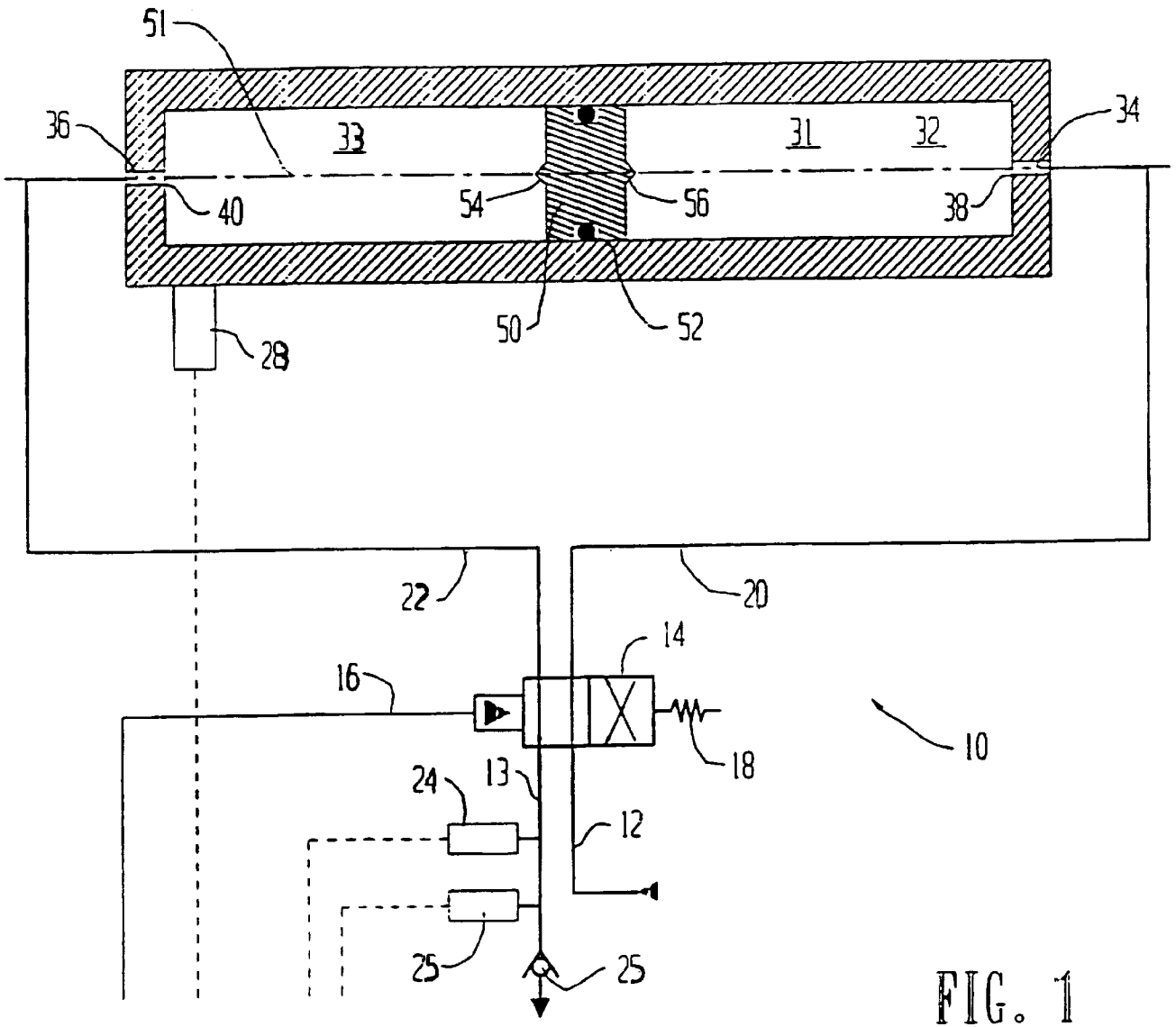
FIG. 1 is a schematic diagram of a control system in accordance with this invention.

FIG. 1 illustrates schematically a control system 10 in accordance with the present invention. Control system 10 is provided at each individual well, with each well receiving a chemical fluid through a supply conduit 12, which flows through a two position valve 14. Valve 14 may be operated hydraulically in response to a signal along line 16 to shift the valve from one position to the other position. The valve preferably is biased by spring 18 to normally reside in a selected position. Chemical fluid transmitted through the valve 14 from the supply line passes through line 20 to a cylinder 30 discussed subsequently, and during that stroke chemical fluid is injected through line 22 through the valve 14, then through a discharge conduit 13 then through the check valve 25 and into the wellhead. Pressure transducer 24 may be provided to provide a signal at the end of stroke operation. Alternatively, a flow transducer 26 may be provided along line 13 for the same purpose, i.e., to detect that the system is finished its injection stroke. Finally, a barrier position sensor 28 may be provided on the cylinder for this same purpose. Each of the sensors 24, 26, 28 is thus able to send a signal which may be transmitted remotely to indicate that the device has achieved a full stroke condition.

As shown in FIG. 1, the hollow cylinder 30 includes a cylinder bore 31, a first input-output port 34 at one end of the cylinder, and a second input-output port 36 substantially at opposing end of the cylinder. Piston 50 moves along axis 51 within the bore 31, and forms a barrier between a first chemical fluid chamber 32 and a second chemical fluid chamber 33. For the embodiment as shown in FIG. 1, fluid flowing into the cylinder 30 along line 20 moves the piston 50 to the left, expelling fluid from the chamber 33 through the line 22 and into the well. At the end of that stroke, the valve 14 may be operated so that fluid then flows to a cylinder 30 along line 22, moving the piston 50 to the right and forcing chemical fluid through the line 20 and into the well. Stroking of the piston 50 thus displaces a fixed volume of fluid within the cylinder bore 31, so that this fixed volume fluid is then injected through the control valve 14 and into the injection point for the individual petroleum well. Operation of the directional control valve reverses direction of the barrier within the cylinder bore, so that another fixed volume of fluid is injected into the well during the reversing travel direction of the barrier within the cylinder bore.

The piston 50 may be provided with valve members 54 and 56 such that, at the end of travel of the piston 50, a respective valve member engages one of the seats 38, 40, thereby providing a positive seal to cut off fluid flow even if the seal 52 were to leak. Various alternative structures may be used for providing a valve which seats in response to movement of the piston to its fully stroked position.

Figure 2:
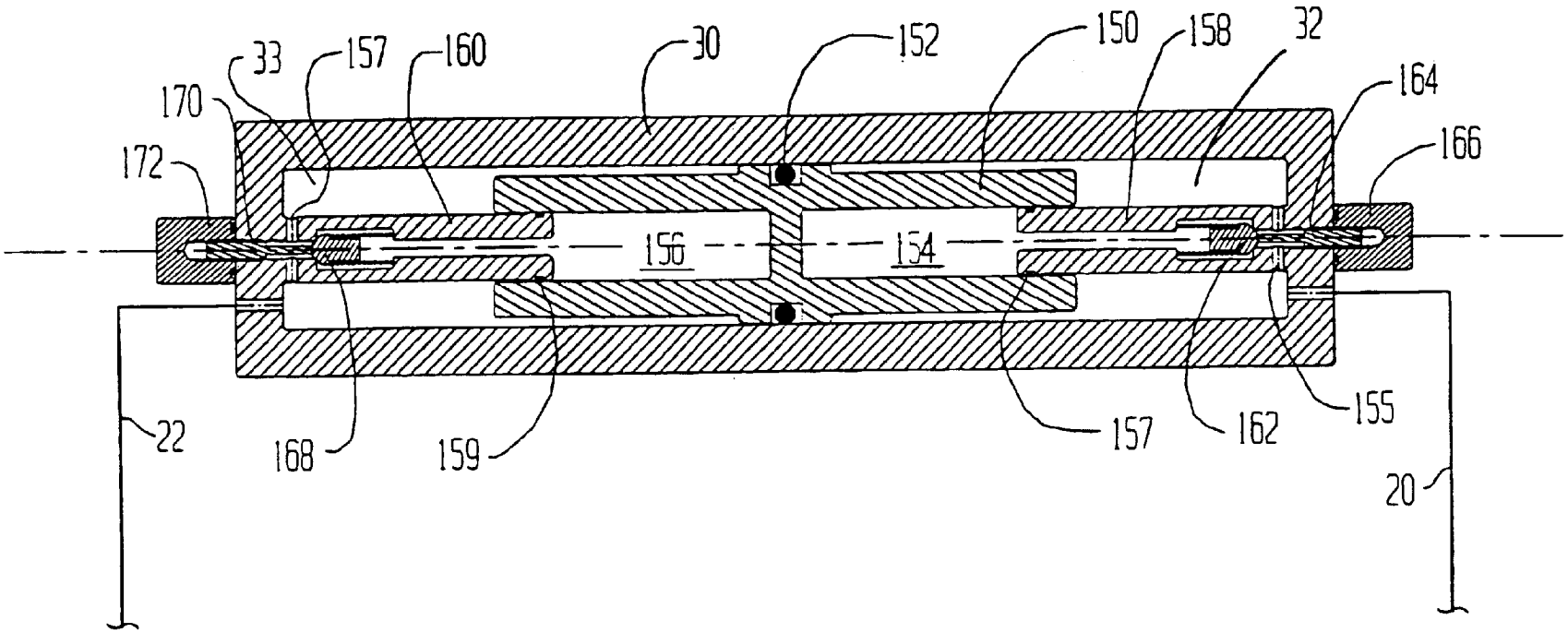
FIG. 2 is a schematic diagram of the control system with the addition of an internal hydraulic dampening chamber formed at each end of the reciprocating piston and an adjustable flow control valve in each hydraulic dampening chamber.

The embodiment as shown in FIG. 2 may be the same as the FIG. 1 embodiment, except for the depicted components. In this case, the piston 150 has a seal 152 which seals with the interior diameter of the cylinder and separates the chemical chamber 32 from the chemical chamber 33. The sleeve-shaped configuration of the piston allows for the use of dampening chambers 154, 156. Opposing extensions 158 and 160 are each secured to the cylinder 30, and are sealed to the piston 150 by the seals 157, 159. An adjustable flow control valve 162 is provided for controlling flow from the chamber 154 to the chamber 32 through flow path 155. Needle 164 may be adjusted and locked and sealed by cover 166 to raise or lower the position of valve 162 with respect to its seat, thereby controlling the flow of fluid between the chamber 154 and the chamber 32. A similar valve 168 controls flow between chamber 33 and dampening chamber 156, with the needle 170 being selectively adjustable and locked and sealed by cover 172. Those skilled in the art will appreciate that adjusting the control valves allows for control of the rate at which fluid passes from a dampening chamber to a respective chamber 32, 33 and from each dampening chamber out the line and to the control valve. If desired, operators could be provided such that needle 164, 170 may be remotely controlled by signals to a powered operator to vary the rate of fluid flow from the cylinder into the injected well during a stroke.

Figure 3:
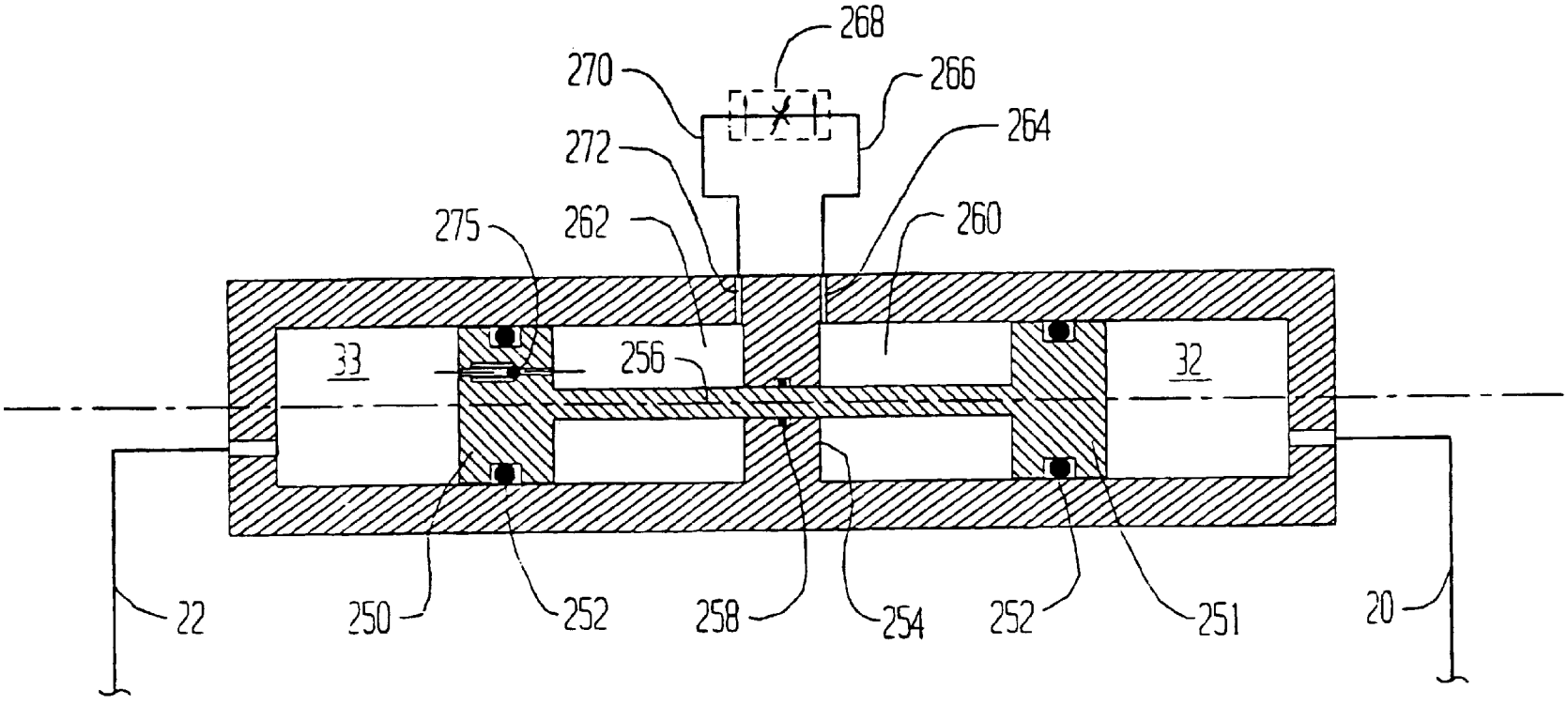
FIG. 3 is a schematic diagram of the control system with the addition of a second piston connected to the first piston by a connecting rod sealably engaged with a reduced bore in the cylinder, thereby forming a hydraulic dampening chamber behind each piston and an adjustable pressure compensated flow control valve connected to each dampening chamber. A check valve penetrates one piston to relieve any trapped pressure in the closed dampening circuit.

FIG. 3 discloses a preferred embodiment which utilizes a piston 250, 251 interconnected by a connecting rod 256, which is sealed to the canter member 254 by seal 258. Seals 252 seal between each piston and the cylinder bore, forming the chemical chambers 32 and 33 discussed above. In this case, injected fluid along line 20 to the chamber 32 forces the connected piston 250, 251 to move together, forcing clean fluid out the dampening chamber 260 through the port 264 and line 266 to the pressure compensated flow control valve 268. Fluid flowing through the valve 268 passes along line 270 and through pod 272 into the dampening chamber 262. The clean fluid flowing between the dampening chambers during each stroke and during the reverse stroke is used as a biasing force to control movement of the piston 250, 251, thereby effectively controlling the injection rate of chemical fluid Into the well. A check valve 275 penetrates piston 250 or piston 261 to allow the escape of any excess pressure in the clean fluid filled dampening chamber 262 or 260, which may occur due to temperature increase or pumping action of seals 252.

Figure 4:
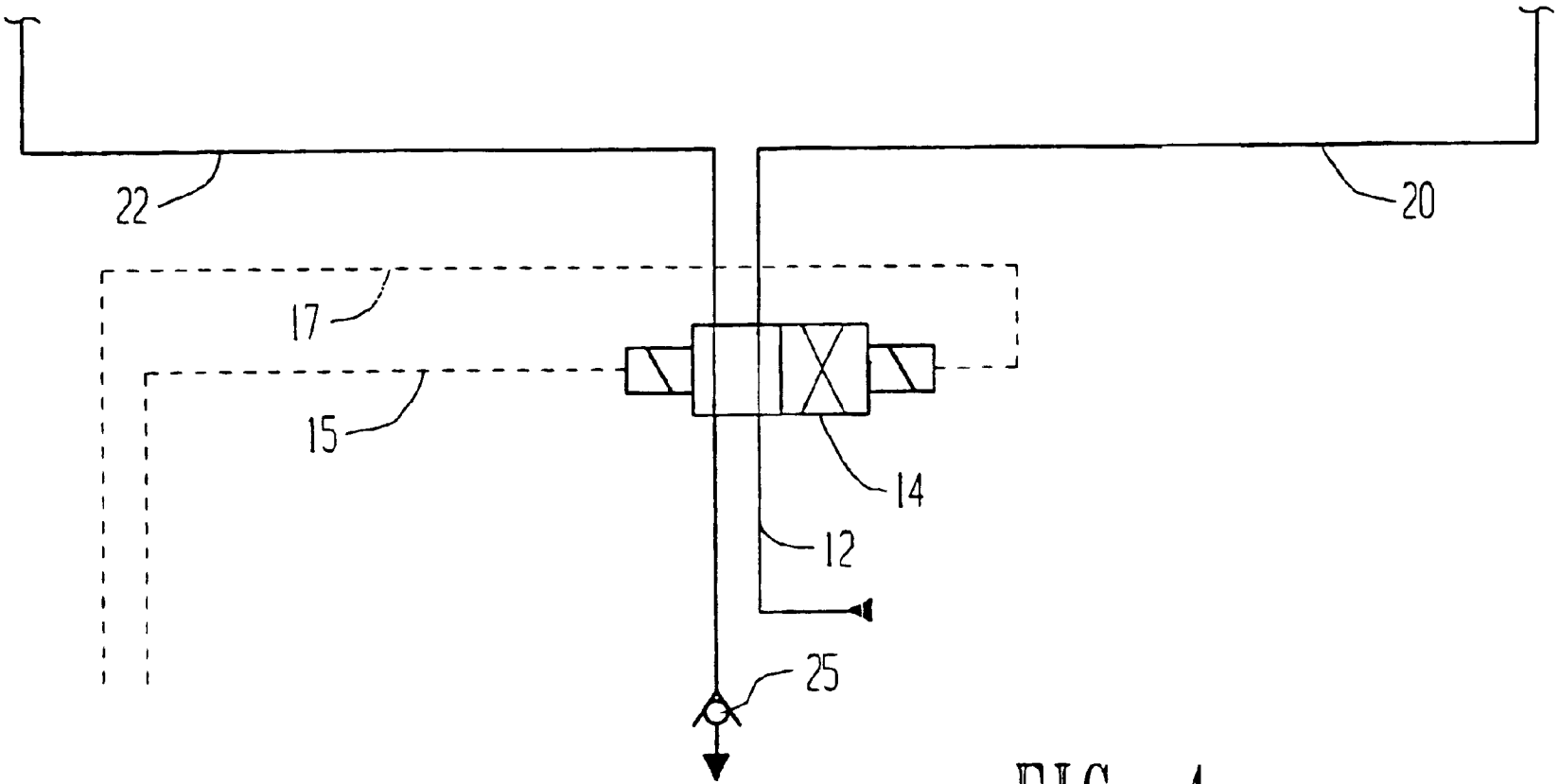
FIG. 4 illustrates the system substantially as shown in FIG. 3 with electric actuation of the control valve and a flow transducer.

FIG. 4 discloses an alternative design wherein the valve 14 is electrically operated. A signal to the valve through one of the lines 15, 17 causes the valve to shift in one direction, while signal to the valve in the opposing line causes the valve to shift in the reverse direction. The two position four way valve may thus be hydraulically actuated, as shown in FIG. 1, or may be electrically actuated, as shown in FIG. 4.

A significant feature of a dynamic seal, such as the moveable seal on a piston which seals between the piston and the cylinder, is that a very thin film of fluid conventionally exists between the elastomeric seal and the inner wall of the cylinder. The moving seal inherently results in additional fluid on one side of the barrier, and in that sense the seal is not fluid tight. This is not inherently undesirable, however, since the fluid is inherently filtered by the function of the seal in creating the thin film on the cylinder wall, and only clean chemical without contamination, grit and other debris may enter the clean fluid in the dampening chambers 260, 262. In some applications, the seals used in this chemical injection control system may include anti-extrusion rings, such as PEEK backup rings, on one on both sides of the elastomeric seal. The elastomeric seal thus functions as a highly reliable fluid barrier, but also functions as a highly reliable filter to filter contaminant out of the fluid and let only clean fluid pass by the seal.

Although a piston is a preferred form of barrier, the barrier alternatively could be a diaphragm, bladder, or bellows. Concerns over the long term interaction of the injected chemical and an elastomeric bladder may require the use of a flexible metal barrier for many applications. Consideration to the seals on the piston is accordingly important for the piston-type barrier, and is one advantage of other barriers, such as a bellows which does not require a seal and may be preferred in some applications.

A pressure compensated flow control valve as disclosed herein is commercially available from various manufacturers, is highly reliable with clean fluid, and acts as a preferred form of a device which provides a substantially constant bias to resist movement of the barrier, thereby effectively controlling the injection rate of the chemicals into the well. In the preferred form, this control valve is pressure compensated, meaning that the pressure differential between the far end of the supply line and the injection point into an individual well has substantially no effect on the rate of flow of the clean fluid from one dampening chamber to the other, and thus the rate of injecting the chemical into the well. Those skilled in the art appreciate that this pressure differential may vary widely as a function of time, changing downhole conditions, and changing conditions in the far end of the supply line which provides the injection chemical to each of a plurality of wells all in the general vicinity of a specific injection well. Those skilled in the art also appreciate that it is highly desirable to control the time of the injection stroke, and that during that injection stroke the injection rate is substantially constant. The control valve is preferably remotely operated, i.e., operated from the remote source using conventional valve operation technology. The function of the two position directional control valve as disclosed herein may be achieved with the plurality of manifolds, if desired, so that the assembly performs the basic function of the two position directional control valve as disclosed herein. Various forms of pressure regulators and conventional valves may alternatively be used to achieve the same function.

In many applications, each of the plurality of wells will receive well fluids from each well at a common tree, while in other cases trees for specific wells may be laid out in a pattern within the general vicinity of a selected injection well. Having one well in the "vicinity" of another well means that the wells are sufficiently close that the chemical fluid is provided through a common supply conduit, and at the end of the common supply conduit, chemical injection lines split or otherwise pass through a manifold which then transmits the injection chemical to each of the individual wells. A pressure compensated control valve may also be adjustable, and conventionally would then include an operator responsive to signals generated at a distance of, e.g., 10 miles or 20 miles from the well. The pressure compensated control valve thus may selectively alter the orifice size through which the clean fluid passes in response to the monitored pressure differential, so that the pressure differential is effectively neutralized and chemical is injected at the desired substantially constant rate. A suitable pressure compensated control valve is the PC Series valve available from Parker Hannifin. A suitable electro-hydraulic flow control valve marketed under the ETPCCS Series is also available from Parker Hannifin.

In a less desired embodiment, the biasing mechanism for exerting the substantially constant force on the barrier could be electrically powered. For example, an electric brake mechanism may be provided for retarding motion of the barrier, so that the resistive force of this electrical brake provided the desired slow, constant rate movement of the barrier to achieve the desired injection rate into the well. Additional problems are encountered providing an electrically powered brake which is easily adjustable. In another embodiment, a mechanical biasing force could be used to provide the resistance to movement of the barrier, e.g., by the use of one or more springs or by the use of a friction pad to resist barrier movement. Again, complications arise providing such a device which is highly reliable, has a relatively low cost, and is easily adjustable at a remote location.

The term "clean fluid" as used herein is broadly intended to mean any fluid other than the injected chemical, contaminated with the particles or debris commonly occurring in the injected chemical by the time it reaches the injection well. In one sense, the clean fluid is "clean" by being isolated from the injection fluid, although that fluid isolation need not be perfect, as discussed above with respect to the use of seals. Hydraulic fluid and other types of clean fluids may be utilized with additives to prolong the life of seals, seats, and orifices. For some applications, a clean fluid which is substantially the clean injection fluid may be used, while in other cases the selected clean fluid may be a chemical other than the injected chemical, such as a hydraulic oil. In the case where the clean fluid is hydraulic oil, a small amount of injected chemical may pass the piston seal and enter one of the dampening chambers and a small amount of hydraulic oil may leak out of a dampening chamber. Even though the composition of the clean fluid is no longer 100 percent hydraulic oil, and may become, for example, 65 percent hydraulic oil and 35 percent chemical over a period of time, the clean fluid is still "clean" since a chemical that passed by the piston seals was cleaned by the seal to remove any significant amount of debris or other contamination.

Each of the components of the chemical injection system according to the present invention may be designed and manufactured to be retrievable by an ROV. The system and method provide a highly reliable technique to inject a specific quantity of chemical from a supply conduit into each of multiple petroleum wells at individually adjustable rates, and also provides various types of alternative equipment for verifying the delivery of the chemical, including a pressure transducer, a position transducer or a flow transducer for verifying the injection of a specific quantity of fluid into the well. A feature of the invention is that the system and method do not require the use of a filter immediately upstream of the cylinder or the control valve, since as disclosed herein, the injected fluid is not passed through a restricted diameter or adjustable orifice while flowing fluid from the supply conduit through the cylinder and then into an individual petroleum well.

The component which houses the moveable piston or other barrier is referred to above as a cylinder, since the device logically may have a cylindrical shape. The term "cylinder" should not be construed, however, to necessarily refer to the shape of the housing for the barrier, since the barrier may have shapes other than that of a cylindrical housing. Similarly, the bore within the cylinder is disclosed as being circular in cross section and thus cylindrical in length, i.e., along a straight axis. A differently configured cylinder bore within the housing may be provided. The term "cylinder bore" as used herein should not be construed as limiting the cross-sectional configuration of the bore or the path of barrier travel, whether along a straight line or a curved line. In either event, the housing or cylinder will have a first input-output port at one end and a second input-output port at an opposing second end. Similarly, the piston is preferably used as a barrier to move within the cylinder bore, but the barrier need not be a piston, and need not have a cylindrical configuration.

Although the operation of the system according to the present invention preferably uses a simplistic travel reversal of the barrier within the bore, travel in one direction may occur without the requirement that the reversing direction always produce the same fixed volume of fluid injected into the well, and without the injection rates being equal. In each application, a fixed volume of fluid from the cylinder is injected when operating the control valve, so that a known volume of fluid is injected during that stroke of the fluid barrier.

The piston or other fluid barriers of the control system of the present invention may need to cycle hundreds of thousands or millions of times during its anticipated life, which typically is 20 plus years. Accordingly, the simplicity of the present invention has significant advantages since highly reliable components are readily available which repeatedly perform their intended function.

It may be appreciated that changes to the details of the illustrated embodiments and systems disclosed are possible without departing from the spirit of the invention. While preferred and alternative embodiments of the present invention have been described in detail, it is apparent that further modifications and adaptations of the preferred and alternative embodiments may occur to those skilled in the art. However, it is to be expressly understood that such modifications and adaptations are within the spirit and scope of the present invention, as set forth in the following claims.

What is claimed is:

1. A chemical injection system for controlling the distribution of a chemical fluid from a supply conduit into an individual petroleum well in the vicinity of multiple petroleum wells at individually adjustable rates, comprising:

a remotely operated two position directional control valve fluidly connected to the supply conduit;

a hollow cylinder having a cylinder bore and a first input-output port at one end and a second input-output port at an opposing second end;

a fluid barrier within the cylinder bore, such that chemical fluid flows from the supply conduit through said control valve to one end of the cylinder bore and forces the barrier to displace a fixed volume of fluid from the cylinder bore, then through the control valve and to an injection point for the individual petroleum well, each operation of the directional control valve reversing travel direction of the barrier within the cylinder bore;

a first damping chamber on one side of the fluid barrier;

a second dampening chamber on an opposing side of the fluid barrier; and one or more valve members for restricting flow from at least one of the first and second dampening chambers.

2. A chemical injection system as defined in claim 1, wherein the barrier comprising a piston sealed with the cylinder.

3. A chemical injection system as defined in claim 1, further comprising:

a pressure transducer for remotely determining that the barrier has displaced the fixed volume of fluid by sensing a pressure reduction in fluid flowing from the cylinder to the individual petroleum well.

4. A chemical injection system as defined in claim 1, further comprising:

a position transducer for remotely determining that the barrier has displaced the fixed volume of fluid by a stroked position of the barrier within the cylinder.

5. A chemical injection system as defined in claim 1, further comprising:

a flow transducer for remotely determining the flow of fluid from the cylinder to the individual petroleum well.

6. A chemical injection system as defined in claim 1, wherein the one or more valve members comprises:

a first adjustable control valve for restricting flow from the dampening chamber to the first input-output port; and a second adjustable control valve for restricting fluid flow from the second dampening chamber to the second input-output port.

7. A chemical injection system as defined in claim 1, further comprising:

the fluid barrier comprising a first barrier and a second barrier moveably connected to the first barrier, the first and second barriers being moveable within the hollow cylinder; and a biasing mechanism for applying a substantially constant rate of movement of the fluid barrier within the cylinder.

8. A chemical injection system as defined in claim 7, wherein the valve member comprises:

a flow control valve for regulating fluid flow between the first dampening chamber and the second dampening chamber during movement of the barrier, such that a clean fluid within the first and second dampening chambers is restricted by the flow control valve when passing between the first chamber and the second chamber during movement of the barrier.

9. A chemical injection system as defined in claim 8, wherein the flow control valve is pressure compensated, such that a pressure differential between a far end of the supply conduit and the injection point for the individual petroleum well has substantially no effect on the flow rate of fluid between the first dampening chamber and the second dampening chamber.

10. A chemical injection system as defined in claim 7, further comprising:

a connector within the cylinder for mechanically interconnecting the first barrier and the second barrier; and a barrier seal in sealed engagement with the connector to seal the first dampening chamber from the second dampening chamber.

11. A chemical injection system as defined in claim 1, further comprising:

a first valve member and a second valve member on the fluid barrier for closing off a respective one of the first input-output port and the second input-output port in response to movement of the fluid barrier.

12. A chemical injection system as defined in claim 1, further comprising:

one or more pressure relief valves in fluid communication with at least one of the first and second dampening chambers to relieve fluid pressure within at least one of the first and second dampening chambers.

13. A chemical injection system for controlling the distribution of fluid from a common supply conduit into each of a plurality of petroleum wells in the general vicinity of an end of the supply conduit, the chemical injection system controlling the injection rate of a chemical fluid into each well at an individually adjustable rate, such that the injection system at each of the plurality of wells comprises an individual well injection system, the chemical injection system comprising:

a remotely operated two position directional control valve fluidly connected to the supply conduit;

a hollow cylinder having a cylinder bore and a first input-output port at one end and a second input-output port at an opposing second end;

a fluid barrier within the cylinder bore, such that chemical fluid flows from the supply conduit through said control valve to one end of the cylinder bore and forces the barrier to displace a fixed volume of fluid from the cylinder bore, then through the control valve and to an injection point for the individual petroleum well, each operation of the directional control valve reversing travel direction of the barrier within the cylinder bore;

a first damping chamber on one side of the fluid barrier;

a second dampening chamber on an opposing side of the fluid barrier;

one or more valve members for restricting flow from at least one of the first and second dampening chambers; and a transducer for remotely determining the flow of chemical fluid into the individual petroleum well.

14. A chemical injection system as defined in claim 13, wherein the one or more valve members comprises:

a first adjustable control valve for restricting flow from the dampening chamber to the first input-output port; and a second adjustable control valve for restricting fluid flow the second dampening chamber to the second input-output port.

15. A chemical injection system as defined in claim 13, each injection system further comprising:

the fluid barrier comprising a first barrier and a second barrier moveably connected to the first barrier, the first and second barriers being moveable within the hollow cylinder;

the first and second dampening chambers being spaced between the first barrier and the second barrier; and a biasing mechanism for applying a substantially constant rate of movement of the fluid barrier within the cylinder.

16. A chemical injection system as defined in claim 15, wherein the valve member comprises:

a flow control valve for regulating fluid flow between the first dampening chamber and the second dampening chamber during movement of the barrier, such that a clean fluid within the first and second dampening chambers is restricted by the flow control valve when passing between the first chamber and the second chamber during movement of the barrier.

17. A chemical injection system as defined in claim 16, wherein the flow control valve is pressure compensated, such that a pressure differential between a far end of the supply conduit and the injection point for the individual petroleum well has substantially no effect on the flow rate of fluid between the first dampening chamber and the second dampening chamber.

18. A chemical injection system as defined in claim 15, each injection system further comprising:

a connector within the cylinder for mechanically interconnecting the first barrier and the second barrier; and a barrier seal in sealed engagement with the connector to seal the first dampening chamber from the second dampening chamber.

19. A chemical injection system as defined in claim 13, further comprising:

a first valve member and a second valve member on the fluid barrier for closing off a respective one of the first input-output port and the second input-output port in response to movement of the fluid barrier.

20. A chemical injection system as defined in claim 13, further comprising:

one or more pressure relief valves in fluid communication with at least one of the first and second dampening chambers to relieve fluid pressure within at least one of the first and second dampening chambers.

21. A method of for controlling the distribution of a chemical fluid from a supply conduit into an individual petroleum well in the vicinity of multiple petroleum wells at individually adjustable rates, the method comprising:

providing a remotely operated two position directional control valve fluidly connected to the supply conduit;

providing a hollow cylinder having a cylinder bore and a first input-output port at one end and a second input-output port at an opposing second end;

providing a fluid barrier within the cylinder bore;

providing a first damping chamber on one side of the fluid barrier;

providing a second dampening chamber on an opposing side of the fluid barrier;

automatically restricting flow from at least one of the first and second dampening chamber; and operating the control valve to flow chemical fluid from the supply conduit through such directional control valve to an opposing end of the cylinder bore to move the barrier and displace a fixed volume of fluid from the cylinder bore, then through the control valve and to the injection point for the individual petroleum well.

22. A method as defined in claim 21, further comprising:

remotely determining that the barrier has displaced the fixed volume of fluid from the cylinder to the individual petroleum well.

23. A method as defined in claim 21, wherein providing the valve member comprises:

providing a first adjustable control valve for restricting flow from the dampening chamber to the first input-output port; and providing a second adjustable control valve for restricting fluid flow from the second dampening chamber to the second input-output port.

24. A method as defined in claim 21, further comprising:

the fluid barrier comprising a first barrier and a second barrier moveably connected to the first barrier, the first and second barriers being moveable within the hollow cylinder;

the first and second dampening chambers being spaced between the first barrier and the second barrier; and applying a biasing mechanism for providing a substantially constant rate of movement of the fluid barrier within the cylinder.

25. A method as defined in claim 26, wherein providing the valve member comprises:

providing a flow control valve for regulating fluid flow between the first dampening chamber and the second dampening chamber during movement of the barrier, such that a clean fluid within the first and second dampening chambers is restricted by the flow control valve when passing between the first chamber and the second chamber during movement of the barrier.

26. A method as defined in claim 25, wherein the flow control valve is pressure compensated, such that a pressure differential between a far end of the supply conduit and the injection point for the individual petroleum well has substantially no effect on the flow rate of fluid between the first dampening chamber and the second dampening chamber.

27. A method as defined in claim 24, further comprising: providing a connector within the cylinder for mechanically interconnecting the first barrier and the second barrier; and providing a barrier seal in sealed engagement with the connector to seal the first dampening chamber from the second dampening chamber.

28. A chemical injection pump as defined in claim 21, further comprising:

mounting a first valve member and a second valve member on the fluid barrier for closing off a respective on of the first input-output port and the second input-output port in response to movement of the fluid barrier.

29. A method as defined in claim 21, further comprising:

automatically relieving excess fluid pressure from at least one of the first and second dampening chambers.

* * * * *

UNITED STATES PATENT AND TRADEMARK OFFICE

CERTIFICATE OF CORRECTION

PATENT NO. : 6,745,838 B2
APPLICATION NO. : 10/185826
DATED : June 8, 2004
INVENTOR(S) : Richard R. Watson It is certified that error appears in the above-identified patent and that said Letters Patent is hereby corrected as shown below:

In column 10, lines 60-61, Claim 23, lines 1-2, delete "providing the valve member comprises" and insert therefor --automatically restricting flow comprises--.

In column 11, line 11, Claim 25, line 1, delete "26" and insert therefor --24--.

In column 12, line 11, Claim 28, line 1, delete "chemical injection pump" and insert therefor --method--.

Signed and Sealed this

Third Day of October, 2006

JON W. DUDAS
*Director of the United States Patent and Trademark Office*